US011031190B2

(12) United States Patent
Wirth et al.

(10) Patent No.: US 11,031,190 B2
(45) Date of Patent: Jun. 8, 2021

(54) MEDIUM OR HIGH VOLTAGE SWITCH HAVING SPHERICAL-BEARING-TYPE MECHANICAL CONNECTION

(71) Applicant: ABB Power Grids Switzerland AG, Baden (CH)

(72) Inventors: Christoph Wirth, Pfungen (CH); Dominique Kurrus, Aesch (CH)

(73) Assignee: ABB Power Grids Switzerland AG, Baden (CH)

( * ) Notice: Subject to any disclaimer, the term of this patent is extended or adjusted under 35 U.S.C. 154(b) by 0 days.

(21) Appl. No.: 16/583,983

(22) Filed: Sep. 26, 2019

(65) Prior Publication Data

US 2020/0098529 A1 Mar. 26, 2020

(30) Foreign Application Priority Data

Sep. 26, 2018 (EP) ..... 18196968

(51) Int. Cl.
*H01H 1/48* (2006.01)

(52) U.S. Cl.
CPC ..... *H01H 1/48* (2013.01); *H01H 2203/024* (2013.01)

(58) Field of Classification Search
CPC .... H01H 1/48; H01H 2203/024; H01H 1/365; H01H 1/021; H01H 33/765; H01H 15/102; H01H 1/54; H01H 1/385; H01H 1/46; H01H 33/02; H01H 1/32
USPC ..... 200/48 R
See application file for complete search history.

(56) References Cited

U.S. PATENT DOCUMENTS 4,154,996 A * 5/1979 Arnold ..... H01H 5/045 200/243
4,594,489 A 6/1986 Gengenbach et al.
4,712,079 A * 12/1987 Marquardt ..... H01H 50/545 200/431
6,025,568 A * 2/2000 Schaeffeler ..... H01H 9/32 218/123
8,822,864 B2 * 9/2014 Borg ..... H01H 3/50 200/538

FOREIGN PATENT DOCUMENTS

DE 883007 C 7/1953

OTHER PUBLICATIONS

European Patent Office, Extended Search Report issued in corresponding Application No. 18196968.4, dated Apr. 2, 2019, 6 pp.

* cited by examiner

*Primary Examiner* — Edwin A. Leon
(74) *Attorney, Agent, or Firm* — Sage Patent Group

(57) ABSTRACT

A medium or high voltage switch including a moveable contact element and a stationary contact element is described. Therein, a moveable-contact guiding portion of the moveable contact element and a stationary-contact guiding portion of the stationary contact element are shaped for establishing a spherical-bearing-type mechanical connection between each other, thereby aligning a center of the moveable-contact guiding portion with a center of the stationary-contact guiding portion while allowing an angular flexion between the moveable and stationary contact elements. Furthermore, at least one of the stationary-contact guiding portion and the moveable-contact guiding portion is electrically insulating.

20 Claims, 4 Drawing Sheets

MEDIUM OR HIGH VOLTAGE SWITCH HAVING SPHERICAL-BEARING-TYPE MECHANICAL CONNECTION

Aspects of the invention relate to a medium or high voltage switch such as an earthing switch, and relate in particular to the moveable contact and its support and electrical connection by the stationary contact elements of the switch.

TECHNICAL BACKGROUND

Medium and high voltage switches include disconnectors (switches not designed for interrupting during load), starting-switch disconnectors and earthing switches, load breakers (switches not designed for interrupting during nominal load) and circuit breakers (switches designed for interrupting fault currents). The present invention is applicable to any of these switches, and in particular to a disconnector, a starting-switch disconnector, and/or an earthing switch, for example for a generator circuit breaker or other switchgear. Herein, medium voltages are defined as voltages above 1 kV and up to 52 kV; and high voltages are defined as voltages above 52 kV (rated RMS voltages).

A switch includes at least one moveable contact element that is moveable along an axis, and a fixed contact. When the switch is opened, the moveable contact element is moved away from the fixed contact element, and thereby an axial dielectric gap is created between the fixed contact element and the moveable contact element.

In addition, a switch comprises a slider contact element for establishing a sliding contact with the moveable contact element, thereby galvanically connecting the moveable contact element to a terminal. Herein, both the slider contact element and the fixed contact element are also referred to as stationary contact elements. Such a conventional switch is described further below with reference to FIGS. 1*a* and 1*b*.

The moveable and stationary contact elements need to engage with each other with high precision in order to allow a low-friction movement as well as a reliable mechanical and electrical connection between the moveable and stationary contact elements. Therefore, during installation, careful adjustment is required to make sure the moveable and stationary contact elements are correctly aligned with the required precision. Furthermore, regular maintenance may be required to ensure that the alignment does not degrade during operation.

Thus, there is a need for a medium or high voltage switch that has improved ease of installation, and/or which can be operated reliably over a wide range of conditions with reduced maintenance requirements.

SUMMARY OF THE INVENTION

In view of the above, a medium or high voltage switch according to claim 1 is provided. According to an aspect, the switch comprises a moveable contact element (10) and a stationary contact element (20, 30). A moveable-contact guiding portion (14, 14') of the moveable contact element (10) and a stationary-contact guiding portion (24, 34) of the stationary contact element (20, 30) are shaped for establishing a spherical-bearing-type mechanical connection between each other, thereby aligning a center of the moveable-contact guiding portion (14, 14') with a center of the stationary-contact guiding portion (24, 34) while allowing an angular flexion between the moveable and stationary contact elements (10, 20, 30). Furthermore, at least one of the stationary-contact guiding portion (24, 34) and the moveable-contact guiding portion (14, 14') is electrically insulating.

In more detail, according to an aspect of the invention, the medium or high voltage switch comprising a moveable contact element and a (first) stationary contact element. The moveable contact element is moveable along an axis for opening and closing the switch. The moveable contact element has a (first) moveable-contact contacting portion, and a (first) moveable-contact guiding portion. The (first) stationary contact element has a (first) stationary-contact contacting portion configured to make an electrical connection with the (first) moveable-contact contacting portion when the switch is closed (and possibly, but not necessarily, also having electrical connection with another part of the moveable contact element when the switch is opened), and a (first) stationary-contact guiding portion, the (first) stationary-contact guiding portion being configured to engage with the (first) moveable-contact guiding portion when the switch is closed (and possibly, but not necessarily, also engaging with another part of the moveable contact element when the switch is opened). At least one of the (first) stationary-contact guiding portion and the (first) moveable-contact guiding portion is electrically insulating. The (first) moveable-contact guiding portion and the (first) stationary-contact guiding portion are shaped for establishing, when the (first) moveable-contact guiding portion and (first) stationary-contact guiding portions are engaged with each other, a spherical-bearing-type mechanical connection between the (first) moveable-contact guiding portion with the (first) stationary-contact guiding portion, thereby aligning a center of the (first) moveable-contact guiding portion with a center of the (first) stationary-contact guiding portion while allowing an angular flexion between the moveable and stationary contact elements. According to a further aspect, the stationary contact element may, for example, be a fixed contact element or a slider contact element as described herein.

According to a further aspect, the moveable contact element may further have a second moveable-contact contacting portion and a second moveable-contact guiding portion. Further, the switch may comprise a second stationary contact element. The second stationary contact element may have a second stationary-contact contacting portion configured to make an electrical connection with the second moveable-contact contacting portion when the switch is closed, and a second stationary-contact guiding portion configured to engage with the second moveable-contact guiding portion when the switch is closed. At least one of the second stationary-contact guiding portion and the second moveable-contact guiding portion may be electrically insulating. The second moveable-contact guiding portion and the second stationary-contact guiding portion may be shaped for establishing, when the second moveable-contact guiding portion and second stationary-contact guiding portions are engaged with each other, a spherical-bearing-type mechanical connection aligning a center of the second moveable-contact guiding portion with a center of the second stationary-contact guiding portion while allowing a flexion between the moveable and second stationary contact elements. Herein, the terms "first" and "second" do not imply any order of switching or other order. The first stationary contact element may for example be a fixed contact element, and the second stationary contact element may be a slider contact element.

Further advantages, features, aspects and details that can be combined with embodiments described herein are evident from the dependent claims, the description and the drawings.

BRIEF DESCRIPTION OF THE FIGURES

The details will be described in the following with reference to the figures, wherein.

DETAILED DESCRIPTION OF THE FIGURES AND OF EMBODIMENTS

Reference will now be made in detail to the various embodiments, one or more examples of which are illustrated in each figure. Each example is provided by way of explanation and is not meant as a limitation. For example, features illustrated or described as part of one embodiment can be used on or in conjunction with any other embodiment to yield yet a further embodiment. It is intended that the present disclosure includes such modifications and variations.

Within the following description of the drawings, the same reference numbers refer to the same or to similar components. Generally, only the differences with respect to the individual embodiments are described. Unless specified otherwise, the description of a part or aspect in one embodiment applies to a corresponding part or aspect in another embodiment as well.

Figure 1A:
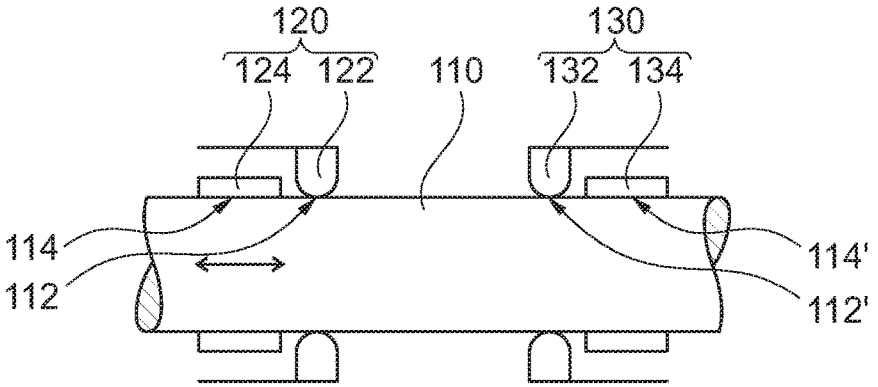
FIGS. 1*a* and 1*b* show a schematic side view of contact elements of a conventional switch.

Before describing embodiments of the invention, some findings of the inventors regarding a conventional switch are described. FIG. 1*a* shows a conventional switch as described in the introductory section, the switch having a moveable contact element 110 that is moveable along an axis (horizontal in FIG. 1*a*), and two stationary contact elements 120 and 130. Contact element 120 is a fixed contact element, and contact element 130 is a slider contact element. The moveable contact element 110 has an end portion on the left side (not shown in FIG. 1*a*), so that when the moveable contact element 110 is moved along the axis (horizontally to the right in FIG. 1*a*), the moveable contact element 110 is separated and moved away from the fixed contact element 120, and the switch is opened, i.e., an axial dielectric gap is created between the fixed contact element 120 and the moveable contact element 110.

The fixed contact element 120 has a contacting portion 122 making an electrical connection with a corresponding contacting portion 112 of the moveable contact 110, and a guiding portion 124 engaging with a corresponding guiding portion 114 of the moveable contact 110.

The slider contact element 130 of the switch of FIG. 1*a* has a structure analogous to that of the fixed contact element 120, having a contacting portion 132 making an electrical connection with a corresponding contacting portion 112' of the moveable contact 110, and further having a guiding portion 134 engaging with a corresponding guiding portion 114' of the moveable contact 110. In contrast to the fixed contact element 120, upon opening of the switch the moveable contact element 110 is moved in direction towards the slider contact element 130, so that no large gap is created, and the contact between the contacting portion 132 and some part of the moveable contact 110 may be maintained.

In the conventional switch of FIG. 1*a*, the guiding portions 114 and 124 establish a sliding connection between each other, for allowing and guiding a relative sliding motion of the guiding portions 114 and 124, and thereby of the moveable contact element 110 relative to the fixed contact element 120. For this purpose, the guiding portion 124 is shaped as a tube with a constant inner circumference corresponding to the outer circumference of the guiding portion 114 of the moveable contact 110 and extending along a certain length along the (horizontal) axis, so that the moveable contact 110 is enabled to slide horizontally therein while being guided. In an analogous manner, sliding connection is established also by the guiding portions 114' and 134.

Figure 1B:
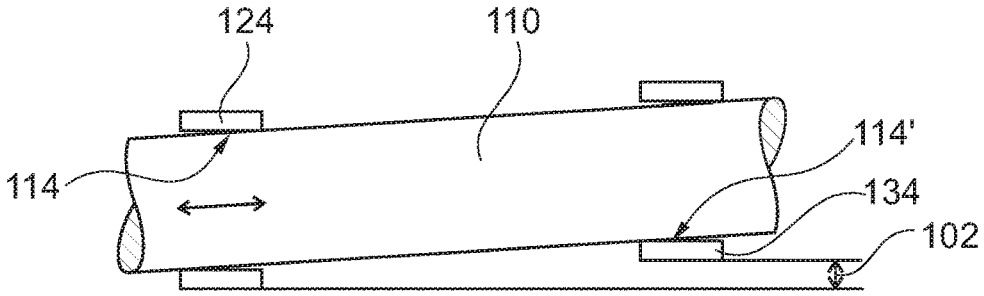

With this switch, a misalignment between different contact elements of the switch must be avoided. FIG. 1*b* shows, for example, a situation in which there is a misalignment 102 between the guiding elements 124 and 134. As a consequence, the moveable contact element 110 becomes inclined relative to the horizontal axis, and the guiding portions 114 and 124, as well as the guiding portions 114' and 134, may wedge with each other at the positions indicated by a circle in FIG. 1*b*. This wedging may lead to increased wear of the switch and/or obstruct the sliding movement. To avoid such wedging, the manufacturing tolerances must be kept very small, and additional alignment steps may be required whereby the manufacturing cost is increased. But, despite these efforts, still wedging may occur due to thermal expansions and other changes in geometry over the lifetime of the switch.

Figure 2A:
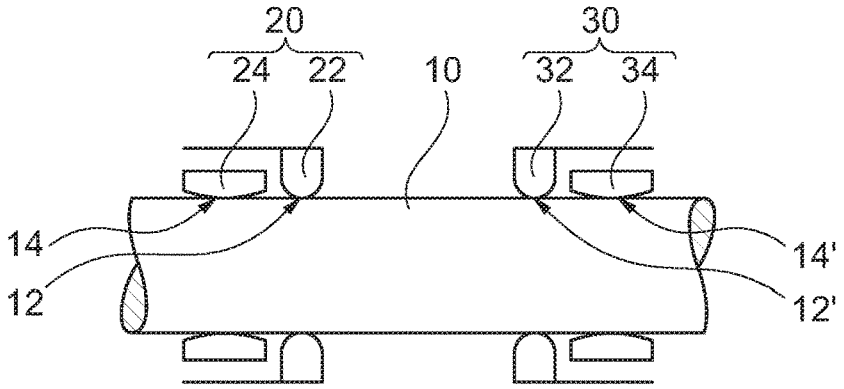
FIGS. 2*a* and 2*b* show a schematic side view of contact elements of a switch according to an embodiment of the invention.
Figure 2B:
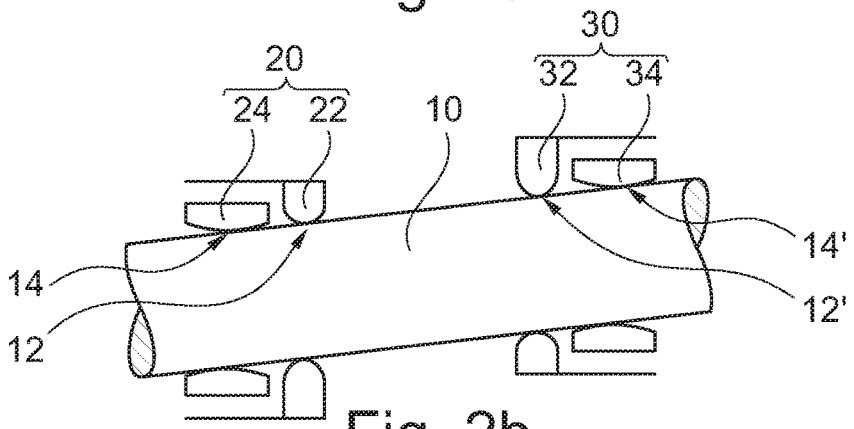

Next, with reference to FIGS. 2*a* and 2*b*, a switch according to an embodiment of the invention is described. In the respects not described in the following, the above description of a conventional switch may also apply to the switch according to embodiments of the invention. Thus, the switch of FIG. 2*a* has a moveable contact element 10, a fixed contact element 20, and a slider contact element 30. Contact elements 20 and 30 are also referred to as stationary contact elements. The moveable contact element 10 has contacting portions 12, 12' and guiding portions 14, 14', also referred to as moveable-contact contacting portions 12, 12' and moveable-contact guiding portions 14, 14' (i.e., contacting/guiding portions of the moveable contact element). Likewise the stationary contact elements 20, 30 have respective stationary-contact contacting portions 22, 32 and stationary-contact guiding portions 24, 34 (i.e., contacting/guiding portions of the stationary contact element). The stationary-contact guiding portions 24, 34 surround the respective moveable-contact guiding portions 14, 14'.

Generally, as can be seen from the above description, the terms "stationary-contact", "moveable-contact" mean that the element belongs to the stationary or moveable contact, e.g. "moveable-contact guiding portion" is the guiding portion of the moveable contact.

In analogy to the switch of FIG. 1*a*, the stationary-contact contacting portions 22, 32 are configured to make an electrical connection with the respective moveable-contact contacting portions 12, 12' when the switch is closed (and, in case of the slider-contact contacting portion 32, also for having an electrical connection with another part of the moveable contact element 10 when the switch is opened). The stationary-contact contacting portions 22, 32 are biased against the moveable contact element 10 by a biasing element such as a spring. Thereby a sufficient contact force is ensured (so that excessive variations of the electrical contact resistance are avoided). Also, the biasing element ensures that the contact force is in a predetermined range for a range of displacements of the stationary-contact contacting portions 22, 32, thereby compensating for variations in displacement due to, e.g., thermal expansion, inclination and/or manufacturing tolerances of the moveable contact element 10.

The stationary-contact guiding portions 24, 34 are configured to engage with the respective moveable-contact guiding portions 14, 14' when the switch is closed. When the switch is opened, there may be no such engagement, e.g., the slider-contact guiding portion 34 may or may not engage with another part of the moveable contact element 10.

However, in contrast to the switch of FIG. 1*a*, in the embodiment of FIG. 2*a* the stationary-contact guiding portions 24, 34 are provided with a curved protruding surface portion which is shaped, in the cross-sectional view of FIG. 2*a*, as a segment of a circle. Due to this protruding surface portion, it becomes possible to incline the moveable contact element 10 without the wedging shown in FIG. 1*b*. Instead, a spherical-bearing-type mechanical connection between the guiding portions 24 and 14 (and, likewise, between the guiding portions 34 and 14') is established.

Herein, a spherical-bearing-type mechanical connection is generally defined by its function to align a center of the moveable-contact guiding portion (here: guiding portions 14, 14') with a center of the stationary-contact guiding portion (here: guiding portions 24, 34), while allowing an angular flexion between the moveable and stationary contact elements (here: contact elements 10, 20, 30). The flexion may be in any plane containing the axis of the switch, i.e., in any rotational orientation about the axis. An alignment of the centers of the moveable-contact and stationary-contact guiding portions is understood to mean that any relative movement (misalignment) of the centers with respect to each other in any radial direction is suppressed. However, a relative movement in axial direction may still be possible. Here radial and axial directions are defined with respect to the axis. The spherical-bearing-type mechanical connection is not limited with respect to relative rotation of the guiding portions with respect to each other about their axes (here: about the horizontal axis in FIG. 2*a*), i.e., such rotation may be allowed or not.

Thus, due to this spherical-bearing-type connection, a center of the respective moveable-contact guiding portion 14, 14' is aligned with a center of the stationary-contact guiding portion 24, 34, but in contrast to the switch of FIGS. 1*a* and 1*b*, an angular flexion between the moveable contact element 10 and the stationary contact elements 20, 30 remains possible. Therefore, in the presence of a misalignment as is shown in FIG. 2*b*, the guiding portions tolerate an offset and a resulting inclination of the moveable contact element 10. Thus, the switch remains functional without wedging due to the switch's ability to allow an angular flexion at the guiding portions.

Generally, the mechanical spherical-bearing connection allows a flexion about an angle in any direction off the axis 6. The possible flexion may be at least 0.5°, possibly even at least 1° or even at least 2°.

An advantage is that due to the spherical-bearing type connection between stationary and moveable contact elements, the switch allows large tolerances in positioning and alignment without its function being impeded. Thereby, a simple and cost-effective manufacturing of the switch is enabled. In particular, no or very limited adjustment is required during installation. Further, even during operation a considerable movement may be possible, and in particular, offsets due to thermal expansion can be absorbed. Embodiments of the invention thus may enable at least some of the following benefits: simple and serial production manufacturing, allows large tolerances in positioning, no adjustment required during installation, increased performances compared to state of the art technology available on the market, further improved mechanical endurance, scalability in the design, optimal power density and low weight. In addition, a consistent contact resistance between the stationary-contact contacting portion and the moveable-contact contacting portion is established in a reliable manner. Thereby, the switch is ensured to operate reliably even in the presence of high peak currents.

Further, in the switch of FIGS. 2*a* and 2*b*, the stationary-contact guiding portions 24, 34 and the moveable-contact guiding portions 14, 14' is electrically insulating. Thereby, it is ensured that current flows exclusively through the contacting portions 22, 32 and 12, 12'.

The embodiment of FIG. 2*a* is essentially axially symmetric with respect to the axis 6. Therefore, the spherical-bearing type connection allows an inclination about any angular direction away from the axis 6.

Next, further embodiments are described. Where not otherwise mentioned or shown, an embodiment described herein corresponds to the previously described ones, and their description is applicable also to the next embodiment, with equal reference numbers referring to corresponding portions of the switch.

The embodiment of FIGS. 3*a* and 3*b* differs from that of FIG. 2*a* in the following respects: The moveable-contact guiding portions 14, 14' are provided with a protruding surface portion (shaped, in the cross-sectional view of FIGS. 3*a* and 3*b*, as a segment of a circle), instead of the stationary-contact guiding portions 24, 34 (which have no such protrusion). Hence, here the spherical-bearing type mechanical connection is established due to the protruding surface of the moveable-contact guiding portions 14, 14'. Due to this spherical-bearing connection, the moveable contact element 10 may be inclined relative to the horizontal axis without wedging, so that the advantages of the embodiment of FIGS. 2*a*, 2*b* are also obtained in the embodiment of FIGS. 3*a*, 3*b*. Further, as a consequence of the non-constant cross-section of the moveable contact element 10, the slider-contact contacting element 32 may be at least temporarily separated from the moveable contact element 10 during a switching operation (i.e., when the moveable contact element 10 is moved to the right in FIG. 3*a*).

A further embodiment is described with reference to FIG. 4*a*. The embodiment of FIG. 4*a* differs from that of FIG. 2*a* in the following respects: The moveable contact element 10 is shaped as a tube with a hollow passage extending (at least partially) along the (in FIG. 4*a* vertical) axis 6 of the switch. The moveable-contact guiding portions 14, 14' are provided at a surface portion of the hollow passage (at an inner surface of the moveable contact element/inwardly oriented). The stationary-contact guiding portions 24, 34 are positioned to be within the hollow passage during engagement with the moveable-contact guiding portions 14, 14' (at a radial center, overlapping the central axis 6), so that the moveable-contact guiding portions 14, 14' radially surround the respective stationary-contact guiding portions 24, 34.

The stationary-contact guiding portions 24, 34 have a substantially spherical shape. In particular, the stationary-contact guiding portions 24, 34 have spherical segments (protruding surface portions) protruding towards the respective moveable-contact guiding portions 14, 14' (which are shaped, in the cross-sectional view of FIG. 4*a*, as straight inner tube walls). Thereby, respective spherical-bearing-type mechanical connections between the moveable-contact guiding portions 14, 14' and the respective stationary-contact guiding portions 24, 34 are established upon engagement with each other, so that the above-described advantages of the spherical-bearing-type mechanical connections are obtained. The stationary-contact guiding portions 24, 34 are provided as (ring-like) inserts 15, 15' of an electrically insulating material into the inner tube wall of the moveable contact portion 10.

Figure 3A:
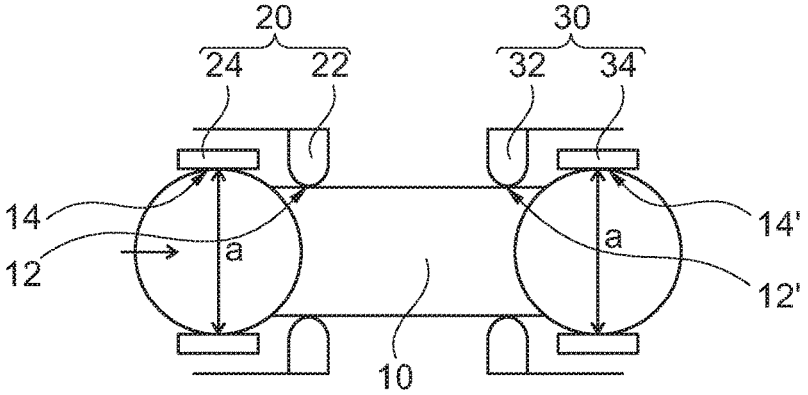
FIGS. 3*a* and 3*b* show a schematic side view of contact elements of a switch according to a further embodiment of the invention.
Figure 3B:
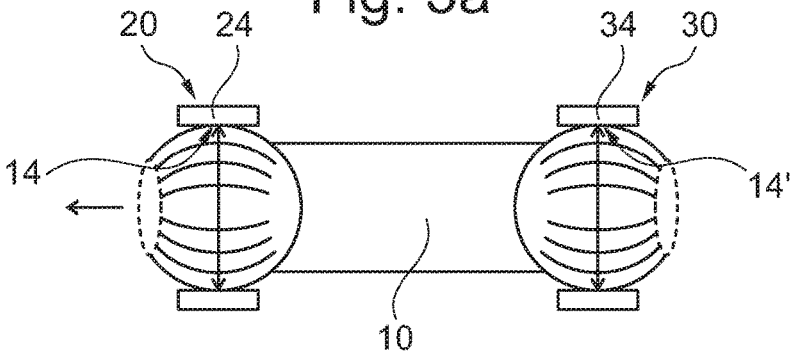

The stationary-contact contacting portions 22, 32 are provided, analogously to those of the embodiments of FIGS. 2*a* and 3*a*, radially surrounding the moveable contact element 10 and contacting the respective moveable-contact contacting portions 12, 12' radially from the outside. The stationary-contact contacting portions 22, 32 are biased towards the respective moveable-contact contacting portions 12, 12' (i.e., radially inwardly). The stationary-contact contacting portions 22, 32 are arranged at the same axial position as the respective stationary-contact guiding portions 24, 34, so that the stationary-contact contacting portion 22 and the stationary-contact guiding portion 24 are arranged in the same cross-sectional plane 26 (overlap within a single cross-sectional plane 26), and so that the stationary-contact contacting portion 32 and the stationary-contact guiding portion 34 are arranged in the same cross-sectional plane 36 (overlap within a single cross-sectional plane 36). Herein, the cross-sectional planes 26, 36 are orthogonal to the axis 6. With this arrangement, even when the moveable contact element 10 is inclined with respect to the axis 6, this is possible with minimal displacement of the stationary-contact contacting portions 22, 32. Therefore, this arrangement ensures a reliable electrical connection through the stationary-contact contacting portions 22, 32, regardless of whether the moveable contact element 10 is inclined.

Figure 4A:
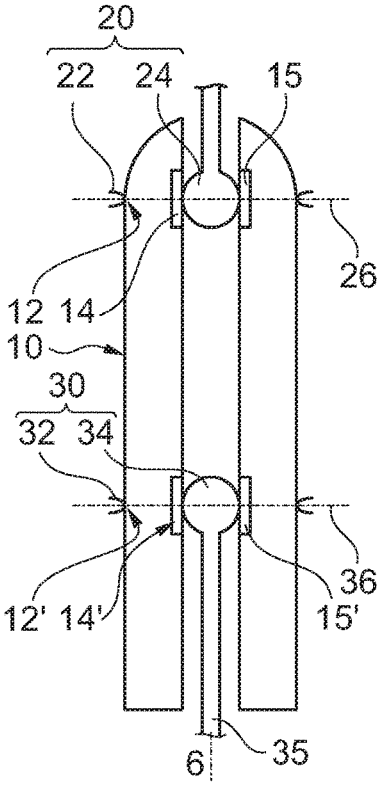
FIGS. 4*a* to 4*c* show schematic cross-sectional side views of different stages during a switching operation of a switch according to a further embodiment of the invention.
Figure 4B:
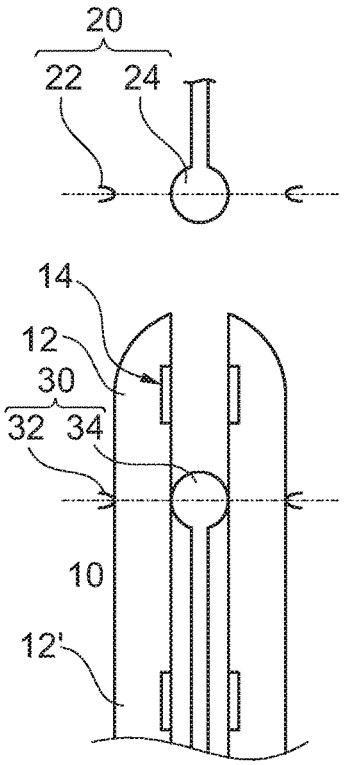
Figure 4C:
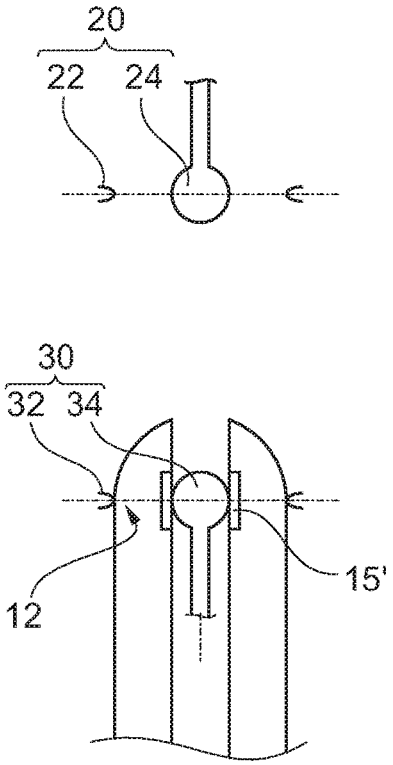

FIGS. 4*b* and 4*c* show different stages of a switching operation of the switch of FIG. 4*a*. Upon opening of the switch, the moveable contact element 10 is moved away from the fixed contact element 20 (in FIGS. 4*a* and 4*b*, downwardly) along the axis 6. Thereby the fixed-contact contacting portion 22 and the moveable-contact contacting portion 12 are separated from each other by a dielectric gap. The movement is effected by any functional design (not shown), for example by a conventional gear known to the person skilled in the art. Finally, when the moveable contact element 10 has been moved away by a specified amount the movement ends and the switch is fully opened, as shown in FIG. 4*c*. Therein, the moveable-contact contact portion 12 is in contact with the stationary-contact contact portion 32. However, this is not a necessity, and the motion may also be stopped at any other position such as the position illustrated in FIG. 4*b*.

The closing of the switch is operated in the opposite order, by moving the moveable contact element 10 towards the fixed contact element 20 until the configuration of FIG. 4*a* is obtained.

While in FIGS. 4*a* to 4*c* the first and second stationary contact elements 20, 30 are structurally similar, this is not necessarily the case, and both stationary contact elements 20, 30 can be varied independently of each other. Any of the stationary contact elements 20, 30 can be replaced, independently of each other, by any other contact element described herein. For example, the stationary contact element 30 can be replaced by the contact element of FIG. 5*f*.

Figure 5A:
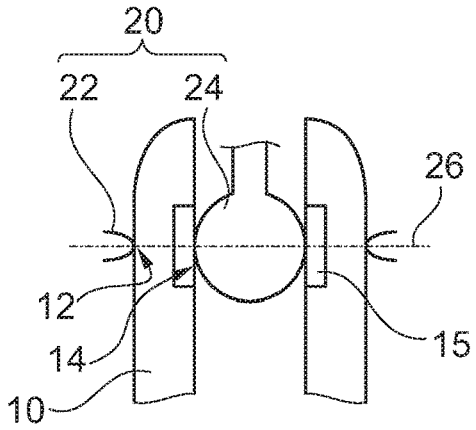
FIGS. 5*a* to 5*g* show schematic cross-sectional side views of possible variants of contact elements of switches according to respective embodiments of the invention.

FIGS. 5*a* to 5*d* illustrate possible variations of the contact elements 10 and 20, applicable for any embodiment or aspect described herein. FIG. 5*a* corresponds to the configuration of FIG. 4*a* and illustrates that the tip of the moveable contact element 10 may be at least partially rounded.

Figure 5B:
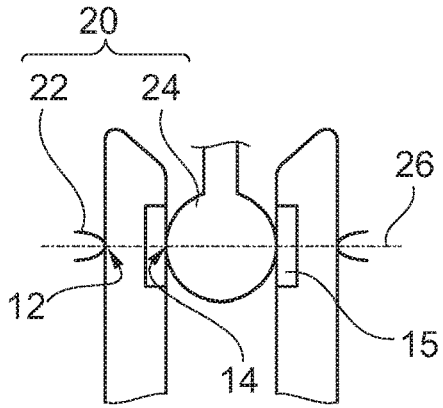

The moveable contact element 10 of FIG. 5*b* corresponds to that of FIG. 5*a*, and has in addition, at its tip portion, a tapered entrance portion to the hollow passage, so that the entrance to the hollow passage is larger in diameter than the hollow passage at the position of the moveable-contact guiding portion 14. The tapered entrance portion facilitates engagement of the moveable contact portion 10 with the fixed contact portion 20 when the switch is being closed.

Thus, FIG. 5*b* illustrates the general aspect that at least one of the stationary-contact guiding portion 24 and the moveable-contact guiding portion 14 may have a tapered surface portion for receiving the other one of the stationary-contact guiding portion 24 and the moveable-contact guiding portion 14 even under axial misalignment of their centers, and for guiding the stationary-contact guiding portion 24 and the moveable-contact guiding portion 14 into axial alignment of their centers while the moveable contact element 10 is being moved along the axis for closing the switch.

Furthermore, FIG. 5*b* illustrates the advantageous general aspect that the tip portion of the moveable contact element 10 may be curved without any sharp edge.

Figure 5C:
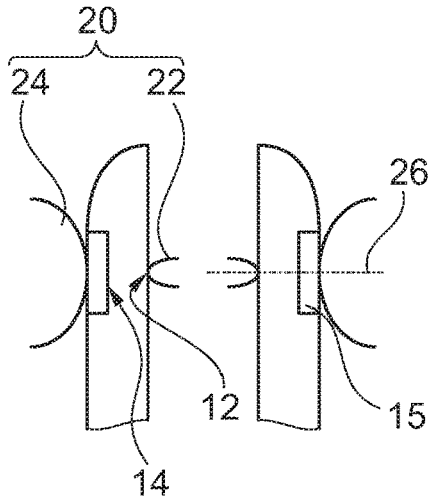

The switch of FIG. 5*c* corresponds to that of FIG. 5*a*, but with the positions of the contacting portions 12, 22 and the guiding portions 14, 34 being interchanged with each other: The moveable-contact contacting portion 12 is provided at an inner side face of the hollow passage of the moveable contact element 10; and the fixed-contact contacting portion 22 is provided inside the hollow passage, facing radially outwardly towards the moveable-contact contacting portion 12 and being biased radially outwardly towards the moveable-contact contacting portion 12. The moveable-contact guiding portion 14 is provided, as an insulating insert, at a radially outwardly facing surface portion of the moveable contact element 10; and the fixed-contact guiding portion 24 radially surrounds the moveable contact element 10, facing radially inwardly towards the moveable-contact guiding portion 14. The fixed-contact guiding portion 24 has a protruding surface portion corresponding to that of the embodiment of FIG. 2*a*.

FIG. 5*c*, in comparison to FIG. 5*a*, illustrates the general aspect that in the case of a moveable contact element with a hollow passage, the parts of the stationary contact(s) radially inside the hollow passage can instead be arranged radially outside the moveable contact element, and/or vice versa.

In all of FIGS. 5*a* to 5*c*, the fixed-contact contacting portion 22 is arranged at the same axial position as the respective stationary-contact guiding portion 24, so that they are arranged in the same cross-sectional plane 26.

Figure 5D:
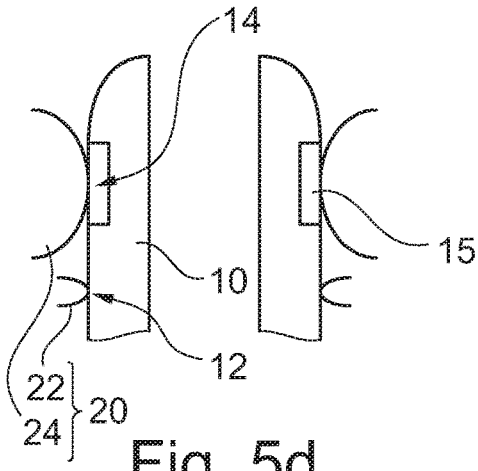

In the switch of FIG. 5*d*, both the fixed-contact contacting portion 22 and the fixed-contact guiding portion 24 are arranged radially outwards of the moveable contact element 10 and are facing radially inwardly. Correspondingly, the moveable-contact contacting portion 12 and the moveable-contact guiding portion 14 are arranged on an outer surface of the moveable contact element 10 facing radially outwardly towards the fixed-contact contacting portion 22 and the fixed-contact guiding portion 24, respectively. The fixed-contact contacting portion 22 and the fixed-contact guiding portion 24 are (although not located at the same axial position) arranged within a short axial distance with respect to each other, the short distance being preferably less than 50 mm, more preferably less than 30 mm. The moveable contact element 10 of FIG. 5*d* is shown having a hollow inside portion, but it may alternatively be solid.

Herein, generally, any positions of any parts of the switch, in particular of any contacting and/or guiding portions, are defined in the closed position of the switch. The positions may, in particular, be the position in which the respective contacting and/or guiding portion contacts a corresponding contacting or guiding portions (e.g. in which a moveable-contact contacting and/or guiding portion contacts the corresponding stationary-contact contacting and/or guiding portion).

Figure 5E:
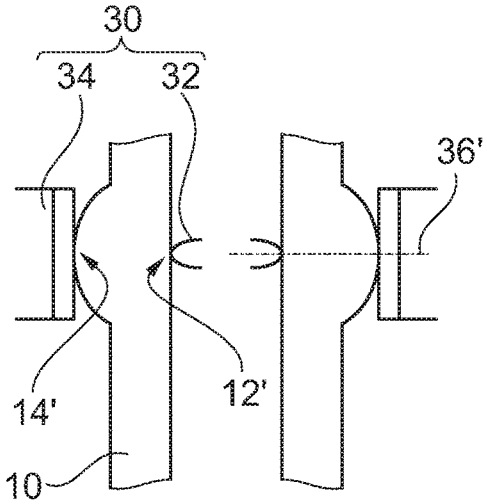
Figure 5F:
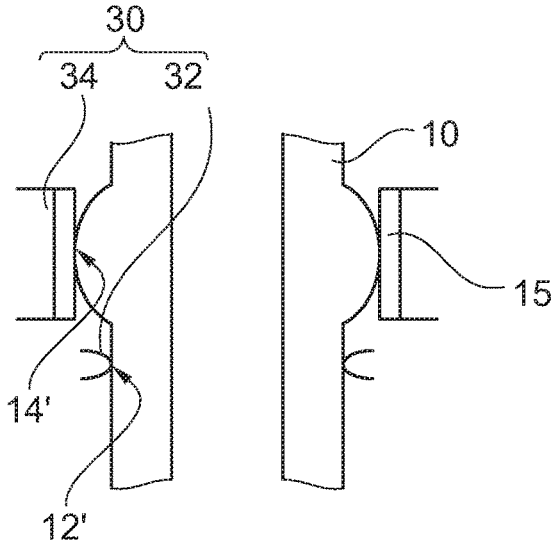

While FIGS. 5*a* to 5*d* (and 5*g* to 7 described below) show the fixed-contact side of the switch, the features shown therein and described above can generally be implemented for any stationary contact, e.g., with the slider contact instead of or in addition to the fixed contact. By means of example, the variations shown in FIGS. 5*e* and 5*f* are shown for the contact elements 10 and 30, i.e., the stationary contact being the slider contact element 30; but the details shown in these FIGS. 5*e*, 5*f* may also be applied to the fixed-contact side of the switch. Overall, FIGS. 5*a* to 7 illustrate the general aspect that any feature described for the moveable and fixed and/or slider contact elements can be applied generally to any stationary contact of the switch (i.e., to the portion of the stationary contact being the fixed contact 20, the portion of the stationary contact being the slider contact element 30, or both portions).

The embodiment of FIG. 5*e* corresponds to that of FIG. 5*c*, but in FIG. 5*e* the moveable-contact guiding portion 14' (and not the stationary-contact guiding portion 34) has the protruding surface portion allowing the mechanical spherical-bearing type connection between the moveable-contact guiding portion 14' with the stationary-contact guiding portion 34. Furthermore, the stationary-contact guiding portion 34 (and not necessarily the moveable-contact guiding portion 14') is electrically isolating.

FIG. 5*e*, in comparison to FIG. 5*c*, illustrates the general aspect that the features of the moveable-contact guiding portion 14 (and/or 14') and those of the stationary-contact guiding portion 24 (and/or 34) can be interchanged with each other.

FIG. 5*f* has, compared to FIG. 5*e*, the same modifications as FIG. 5*d* compared to FIG. 5*c*: Both the stationary-contact contacting portion 32 and the stationary-contact guiding portion 34 are arranged radially outwards of the moveable contact element 10, and the moveable-contact contacting portion 12' and the moveable-contact guiding portion 14' are arranged on an outer surface of the moveable contact element 10 facing radially outwardly, with a short axial distance from one another. While in FIG. 5*f* the stationary-contact contacting portion 32 is placed below the stationary-contact guiding portion 34 (farther away from the fixed contact element 20 not shown in FIG. 5*f*), this order may be reversed, so that the stationary-contact contacting portion 32 (and the moveable-contact contacting portion 12') is/are placed above the stationary-contact guiding portion 34 (i.e., closer to the fixed contact element 20).

Figure 5G:
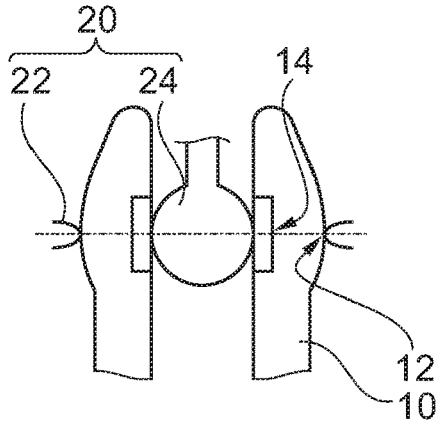

The switch of FIG. 5*g* corresponds to that of FIG. 5*a*, but in addition the moveable-contact contacting surface 12 has a curved protruding surface portion protruding towards the fixed-contact contacting surface 22. Thereby, it is ensured that in the closed state of the switch, the fixed-contact contacting surface 22 is biased towards the moveable-contact contacting surface 12 with a large contacting force, while the biasing force is reduced, or the contact is ended, when the switch is being opened.

Figure 6A:
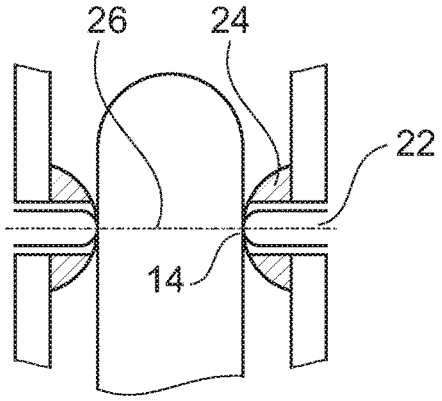
FIG. 6*a* shows a schematic cross-sectional side view of contact elements of a switch according to a further embodiment of the invention.
Figure 6B:
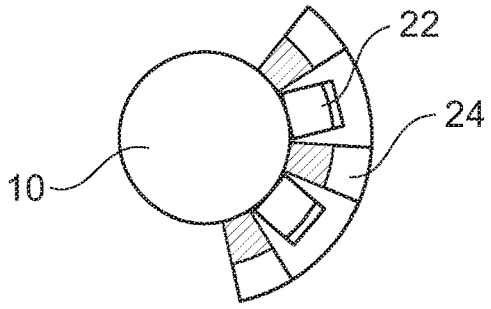
FIG. 6*b* shows a schematic cross-sectional axial view of the contact elements of FIG. 6*a*.

FIGS. 6*a* and 6*b* show a switch according to a further embodiment. Therein, like in FIG. 5*d*, both the fixed-contact contacting portion 22 and the fixed-contact guiding portion 24 are arranged radially outwards of the moveable contact element 10 and are facing radially inwardly (contacting the respective moveable-contact contacting portion 12 and the moveable-contact guiding portion 14). The fixed-contact contacting portion 22 and the fixed-contact guiding portion 24 are arranged at the same (or at least an overlapping) axial position within a single perpendicular plane 26. Nevertheless, the fixed-contact contacting portion 22 and the fixed-contact guiding portion 24 are spatially separated from each other. This is achieved by a circumferentially alternating arrangement of the fixed-contact contacting portion 22 and the fixed-contact guiding portion 24, as can be seen in FIG. 6*b* showing an axial view (from top of FIG. 6*a*) of the switch. The fixed-contact guiding portion 24 is electrically insulating.

Figure 7:
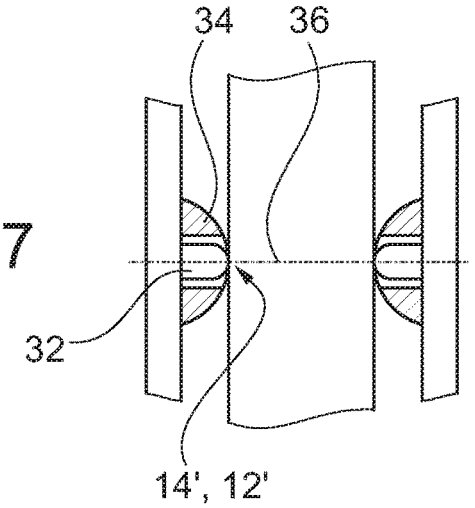
FIG. 7 shows a schematic cross-sectional side view of contact elements of a switch according to a further embodiment of the invention.

The switch of FIG. 7 corresponds to that of FIGS. 6*a* and 6*b*, but here the slider contact element 30 is shown with the same features as the fixed contact element 20 of FIGS. 6*a* and 6*b*.

FIGS. 5*a* to 7 illustrate general aspects of the the contact elements 10 and 20 and/or 30. The details shown in these Figures can, for example, be used in combination with the (remaining) configuration of FIG. 4*a*, but also in combination with any other embodiment or aspect described herein.

Next, further general (optional) aspects of the invention are described. Therein, the reference numbers of the Figures are used merely for illustration. The aspects are, however, not limited to any particular embodiment. Instead, any aspect described herein can be combined with any other aspect(s) or embodiments described herein unless specified otherwise.

According to an aspect, at least one of the moveable-contact guiding portion (14, 14') and the stationary-contact guiding portion (24, 34) has a curved surface portion protruding towards the other one of the moveable-contact guiding portion (14, 14') and the stationary-contact guiding portion (24, 34) for establishing, when the moveable-contact guiding portion (14, 14') and stationary-contact guiding portions (24, 34) are engaged with each other, the mechanical spherical-bearing type connection between the moveable-contact guiding portion (14, 14') with the stationary-contact guiding portion (24, 34).

According to a further aspect, the stationary-contact contacting portion (22, 32) is mounted on an elastic element biasing the stationary-contact contacting portion (22, 32) towards the moveable-contact contacting portion (12, 12'). The elastic element may be a spring such as a leaf spring.

According to a further aspect, the stationary-contact contacting portion (22, 32) is electrically conductive. In case of the fixed-contact contacting portion (32) it may be electrically connected to a terminal. According to a further aspect, the moveable-contact contacting portion (12, 12') is electrically conducting.

According to a further aspect, the stationary-contact guiding portion (14, 14') is electrically insulating. According to a further aspect, the moveable-contact guiding portion (12, 12') is electrically insulating. The moveable-contact guiding portion (12, 12') may be an electrically insulating insert provided at a conducting material of the moveable contact element (10).

According to a further aspect, the stationary-contact contacting portion (22, 32), the moveable-contact contacting portion (12, 12'), the stationary-contact guiding portion (24, 34) and the moveable-contact guiding portion (14, 14') have an axial distance of less than a cross-sectional diameter of the moveable contact element (10). Herein, the cross-sectional diameter of the moveable contact element (10) is defined as the maximum diameter at the point of contact. Preferably, the axial distance is less than 50%, or even less than 30% of the diameter. Preferably, the axial distance is less than 10 mm, more preferably less than 6 mm. Preferably, the above-mentioned contacting and guiding portions (12, 14, 22 and 24; and/or 12', 14', 32 and 34) are arranged in the same cross-sectional plane (26, 36) (to overlap within a single cross-sectional plane (26, 36) perpendicular to the axis (6)). According to a further aspect, these contacting and guiding portions are at least within a short axial distance from each other.

According to a further aspect, at least one of the moveable-contact guiding portion (14, 14') and the stationary-contact guiding portion (24, 34) has a protruding surface portion protruding towards the other one of the moveable-contact guiding portion (14, 14') and the stationary-contact guiding portion (24, 34) for establishing, when the moveable-contact guiding portion (14, 14') and stationary-contact guiding portions (24, 34) are engaged with each other, the mechanical spherical-bearing type connection between the moveable-contact guiding portion (14, 14') with the stationary-contact guiding portion (24, 34).

According to a further aspect, the protruding surface portion is convex, preferably at least one of curved, shaped as a segment of a sphere, shaped as a segment of a convex polygon (preferably having angles of less than 30° or even less than 15° with respect to each other), shaped so as to locally engage with the other one of the moveable-contact guiding portion (14, 14') and the stationary-contact guiding portion (24, 34). The axial length of the engagement is preferably at most 10 mm, more preferably at most 6 mm. According to a further aspect, the curved surface portion is curved, preferably having a section shaped as a section of a circle, in a cross-sectional plane containing the axis (6).

According to a further aspect, the (first and/or second) moveable-contact guiding portion (14, 14') is arranged radially surrounding the (first and/or second) stationary-contact guiding portion (24, 34). Additionally or alternatively, the (first and/or second) stationary-contact contacting portion (22, 32) may be arranged radially surrounding the (first and/or second) moveable-contact contact portion (12, 12').

According to a further aspect, the first and second contact elements (10, 20, 30) are essentially axially symmetric about the axis (6).

According to a further aspect, the stationary-contact guiding portion (24, 34) is arranged at a center overlapping with the axis (6).

According to a further aspect, the moveable-contact guiding portion (14, 14') is spatially separated from the moveable-contact contacting portion (12); the stationary-contact guiding portion (24, 34) is spatially separated from the stationary-contact contacting portion (22, 32).

According to a further aspect, the mechanical connection allows a flexion about an angle in any direction off the axis (6). According to a further aspect, the mechanical connection allows a flexion about an angle of at least 0.5°, preferably of at least 1°, more preferably of at least 2° or even at least 3°.

According to a further aspect, moveable contact (10) has a hollow passage extending in an axial direction within the moveable contact (10), preferably to an axial end thereof. According to a further aspect, at least one of the stationary-contact guiding portions (24, 34) and the stationary-contact connecting portions (22, 32) are positioned within the hollow passage (when the switch is closed). According to a further aspect, at least one of the stationary-contact guiding portions (24, 34) and the stationary-contact connecting portions (22, 32), are arranged at a radial center, overlapping the central axis (6). According to a further aspect, the moveable-contact guiding portions (14, 14') radially surround the respective stationary-contact guiding portions (24, 34). According to a further aspect, the moveable-contact contacting portions (12, 12') radially surround the respective stationary-contact contacting portions (22, 32).

According to a further aspect, the moveable contact (10) is solid (without a hollow passage), with a solid portion at a radial center, overlapping the central axis (6). According to a further aspect, at least one of the stationary-contact guiding portions (24, 34) and the stationary-contact connecting portions (22, 32) are positioned to radially surround the moveable contact (10).

For any aspects described herein relating to any stationary contact element, it is understood that these aspects can be applied, in particular, to the fixed and/or the slider contact element.

The invention claimed is:

1. A medium or high voltage switch comprising:

a moveable contact element being moveable along an axis for opening and closing the medium or high voltage switch, the moveable contact element comprising a moveable-contact contacting portion, and a moveable-contact guiding portion, a stationary contact element comprising a stationary-contact contacting portion configured to make an electrical connection with the moveable-contact contacting portion when the medium or high voltage switch is closed, and a stationary-contact guiding portion, the stationary-contact guiding portion being configured to engage with the moveable-contact guiding portion when the medium or high voltage switch is closed, wherein at least one of the stationary-contact guiding portion and the moveable-contact guiding portion is electrically insulating, and wherein the moveable-contact guiding portion and the stationary-contact guiding portion are shaped for establishing, when the moveable-contact guiding portion and stationary-contact guiding portions are engaged with each other, a spherical-bearing mechanical connection between the moveable-contact guiding portion with the stationary-contact guiding portion, thereby aligning a center of the moveable-contact guiding portion with a center of the stationary-contact guiding portion while allowing an angular flexion between the moveable contact element and the stationary contact element.

2. The medium or high voltage switch according to claim 1, wherein the stationary contact element is a fixed contact element arranged such that when the medium or high voltage switch is opened, the moveable contact element is moved away from the fixed contact element whereby an axial dielectric gap is created between the fixed contact element and the moveable contact element.

3. The medium or high voltage switch according to claim 2, wherein at least one of the stationary-contact guiding portion and the moveable-contact guiding portion has a tapered surface portion for receiving the other one of the stationary-contact guiding portion and the moveable-contact guiding portion even under axial misalignment of their centers, and for guiding the stationary-contact guiding portion and the moveable-contact guiding portion into axial alignment of their centers while the moveable contact element is moved along the axis for closing the medium or high voltage switch.

4. The medium or high voltage switch according to claim 1, wherein the stationary contact element is a slider contact element.

5. The medium or high voltage switch according to claim 1, wherein the stationary contact element is a first stationary contact element, the moveable-contact contacting portion is a first moveable-contact contacting portion, the moveable-contact guiding portion is a first moveable-contact guiding portion, the stationary-contact contacting portion is a first stationary-contact contacting portion, and the stationary-contact guiding portion is a first stationary-contact guiding portion, wherein the moveable contact element further has a second moveable-contact contacting portion, and a second moveable-contact guiding portion, and wherein the medium or high voltage switch further comprises a second stationary contact element, the second stationary contact element having:

a second stationary-contact contacting portion configured to make an electrical connection with the second moveable-contact contacting portion when the medium or high voltage switch is closed, and a second stationary-contact guiding portion configured to engage with the second moveable-contact guiding portion when the medium or high voltage switch is closed, wherein the second moveable-contact guiding portion and the second stationary-contact guiding portion are shaped for establishing, when the second moveable-contact guiding portion and the second stationary-contact guiding portion are engaged with each other, a second spherical-bearing mechanical connection aligning a center of the second moveable-contact guiding portion with a center of the second stationary-contact guiding portion while allowing a flexion between the moveable contact element and the second stationary contact element.

6. The medium or high voltage switch according to claim 1, wherein the spherical-bearing mechanical connection allows a flexion about an angle in any direction off the axis.

7. The medium or high voltage switch according to claim 1, wherein the spherical-bearing mechanical connection allows a flexion about an angle of at least 0.5°.

8. The medium or high voltage switch according to claim 1, wherein the stationary-contact contacting portion is mounted on an elastic element biasing the stationary-contact contacting portion towards the moveable-contact contacting portion.

9. The medium or high voltage switch according to claim 1, wherein the stationary-contact contacting portion, the moveable-contact contacting portion, the stationary-contact guiding portion and the moveable-contact guiding portion each have an axial distance of less than 6 mm.

10. The medium or high voltage switch according to claim 1, wherein at least one of the moveable-contact guiding portion and the stationary-contact guiding portion has a protruding surface portion protruding towards the other one of the moveable-contact guiding portion and the stationary-contact guiding portion for establishing, when the moveable-contact guiding portion and the stationary-contact guiding portion are engaged with each other, the mechanical spherical-bearing connection between the moveable-contact guiding portion with the stationary-contact guiding portion.

11. The medium or high voltage switch according to claim 10, wherein the protruding surface portion is convex.

12. The medium or high voltage switch according to claim 1, wherein the moveable-contact guiding portion is arranged radially surrounding the stationary-contact guiding portion and/or wherein the stationary-contact contacting portion is arranged radially surrounding the moveable-contact contacting portion.

13. The medium or high voltage switch according to claim 5, wherein the first stationary contact element and the second stationary contact element are essentially axially symmetric about the axis.

14. The medium or high voltage switch according to claim 1, wherein the medium or high voltage switch comprises a starting-switch disconnector or an earthing switch.

15. A medium or high voltage circuit breaker having at least one of a starting-switch disconnector and an earthing switch according to claim 14.

16. The medium or high voltage circuit breaker of claim 15, wherein the medium or high voltage circuit breaker is a generator circuit breaker.

17. The medium or high voltage switch according to claim 5, wherein the second stationary contact element is a slider contact element.

18. The medium or high voltage switch according to claim 9, wherein the stationary-contact guiding portion and the moveable-contact guiding portion are arranged to overlap with a single common plane perpendicular to the axis.

19. The medium or high voltage switch according to claim 3, wherein the stationary contact element is a slider contact element.

20. The medium or high voltage switch according to claim 11, wherein the protruding surface portion is shaped as a segment of a sphere or shaped as a segment of a convex polygon.

* * * * *